US009546666B2

(12) United States Patent
Lee et al.

(10) Patent No.: US 9,546,666 B2
(45) Date of Patent: Jan. 17, 2017

(54) IMPELLER FOR FUEL PUMP OF VEHICLE

(71) Applicant: COAVIS, Yeongi-gun (KR)

(72) Inventors: Bong Ju Lee, Daejeon (KR); Hyun Tae Lee, Sejong-si (KR); Seong Hwan Moon, Daejeon (KR); Mun Sik Jeon, Cheongju-si (KR); In Seok Sohn, Cheongju-si (KR)

(73) Assignee: COAVIS, Yeongi-Gun (KR)

( * ) Notice: Subject to any disclaimer, the term of this patent is extended or adjusted under 35 U.S.C. 154(b) by 369 days.

(21) Appl. No.: 14/328,880

(22) Filed: Jul. 11, 2014

(65) Prior Publication Data

US 2015/0050155 A1 Feb. 19, 2015

(30) Foreign Application Priority Data

Aug. 14, 2013 (KR) ..... 10-2013-0096456

(51) Int. Cl.
*F04D 29/24* (2006.01)
*F04D 29/18* (2006.01)

(52) U.S. Cl.
CPC ..... *F04D 29/242* (2013.01); *F04D 29/188* (2013.01)

(58) Field of Classification Search
CPC ..... F04D 29/242; F04D 29/188; F04D 5/002; F02M 37/048; F02M 3/1037
USPC ..... 415/52.1
See application file for complete search history.

(56) References Cited

U.S. PATENT DOCUMENTS 6,132,185 A * 10/2000 Wilhelm ..... F04D 5/002 415/55.1
6,454,520 B1 * 9/2002 Pickelman ..... F04D 29/188 415/55.1
7,507,065 B2 * 3/2009 Ando ..... F02M 37/048 415/55.2
8,123,459 B2 * 2/2012 Tomomatsu ..... F04D 5/005 415/58.4
9,074,607 B2 * 7/2015 Lee ..... F04D 29/188

FOREIGN PATENT DOCUMENTS

JP 02099793 4/1990
JP 2006022759 1/2006
KR 1020120113332 10/2012

* cited by examiner

*Primary Examiner* — Dwayne J White
*Assistant Examiner* — Topaz L Elliott
(74) *Attorney, Agent, or Firm* — Cantor Colburn LLP

(57) ABSTRACT

Provided is an impeller for a fuel pump of a vehicle capable of decreasing a magnitude of high frequency fluid noise due to high speed rotation of the impeller by upper and lower blades of impeller blades positioned between upper and lower casings of the fuel pump and coupled to a shaft of a driving motor to deliver a fuel by rotational force so as to have asymmetrical angles based on the center of a thickness of an impeller body in sucking the fuel from a fuel tank and supplying the fuel to an engine of an internal combustion engine.

4 Claims, 7 Drawing Sheets

| Voltage[V] | 10 | 11 | 12 | 13 | 14 |
|---|---|---|---|---|---|
| THE PRIOR ART | 30.5 | 33.3 | 40.4 | 41.8 | 44.8 |
| THE PRESENT INVENTION | 28.7 | 30.1 | 33.5 | 39.5 | 41.3 |

| Voltage [V] | THE PRIOR ART | THE PRESENT INVENTION |
|---|---|---|
| 7 | 20.31 | 21.28 |
| 8 | 23.29 | 23.89 |
| 9 | 24.72 | 25.36 |
| 10 | 25.11 | 25.79 |
| 11 | 25.1 | 25.67 |
| 12 | 24.63 | 25.16 |
| 13 | 23.59 | 24.05 |
| 14 | 21.96 | 22.97 |

IMPELLER FOR FUEL PUMP OF VEHICLE

CROSS-REFERENCE TO RELATED APPLICATIONS

This application claims priority under 35 U.S.C. §119 to Korean Patent Application No. 10-2013-0096456, filed on Aug. 14, 2013, in the Korean Intellectual Property Office, the disclosure of which is incorporated herein by reference in its entirety.

TECHNICAL FIELD

The following disclosure relates to an impeller for a fuel pump of a vehicle. More particularly, the following disclosure relates to an impeller for a fuel pump of a vehicle capable of decreasing a magnitude of high frequency fluid noise due to high speed rotation of the impeller by improving shapes of impeller blades positioned between upper and lower casings of the fuel pump and coupled to a shaft of a driving motor to deliver a fuel by rotational force in sucking the fuel from a fuel tank and supplying the fuel to an engine of an internal combustion engine.

BACKGROUND

Generally, a fuel pump of a vehicle is mounted in a fuel tank of the vehicle and serves to suck a fuel and forward the fuel to a fuel injection device mounted in an engine.

In addition, the fuel pump of the vehicle is classified into a mechanical fuel pump and an electrical fuel pump, and a turbine type fuel pump 10, which is a kind of electrical fuel pump, is mainly used in an engine using gasoline as the fuel.

The turbine type fuel pump 10 is configured to include a driving motor 20 disposed in a motor housing 60 thereof, upper and lower casings 30 and 40 disposed at a lower end portion of the motor housing 60 and closely adhered to each other, and an impeller 50 disposed between the upper and lower casings 30 and 40, as shown in FIG. 1. In addition, the impeller 50 is coupled to a shaft 21 of the driving motor 20 to thereby be rotated together with the driving motor 20.

That is, as the impeller 50 is rotated, a pressure difference is generated, such that a fuel is sucked into the impeller 50, and pressure of the fuel rises by a rotational flow generated by continuous rotation of the impeller 50, such that the fuel is discharged.

Therefore, the fuel is introduced into a fuel inlet 41 of the lower casing 40 and then passes through the rotating impeller 50, such that pressure of the fuel is raised. Then, the fuel flows to a check valve 70 formed at an upper portion of the motor housing 60 along an inner portion of the motor housing 60 through a fuel outlet 31 of the upper casing 30 and is then supplied to a fuel injection device mounted in an engine of a vehicle.

Here, the impeller 50 includes several blades 51 formed in a disk shape in an outward direction of a circumferential surface thereof along the circumferential surface thereof and blade chambers 52 formed between the respective blades 51 so as to penetrate through both surfaces of the impeller 50 as shown in FIG. 2, and the fuel is introduced into the fuel inlet 41 of the lower casing 40, such that a rotational flow is generated in a space between the blade chamber 52 and a lower flow passage groove 42 formed in the lower casing 40 and an upper flow passage groove 32 formed in the upper casing 30 and a circulation process in which the fuel is introduced into a blade chamber 52 adjacent to the lower flow passage to generate the rotational flow is repeated to convert kinetic energy due to the rotation of the impeller 50 into pressure energy of the fuel, such that the fuel is delivered to the fuel outlet 31 of the upper casing 30, as shown in FIG. 3.

Further, the impeller 50 according to the prior art includes a circumference center guider 53 formed at the center of the circumferential surface thereof along the circumferential surface thereof, thereby making it possible to efficiently generate the rotational flow formed in a space between the blade chamber 52 and the lower flow passage groove 42 and the rotational flow formed in a space between the blade chamber 52 and the upper flow passage groove 32.

However, the fuel introduced into the fuel inlet flows along the lower flow passage groove 42 of the lower casing 40 and then flows the upper flow passage groove 32 of the upper casing 30 through the blade chamber 52 at an end of the lower flow passage groove 42. In this case, impact of a fluid is generated in the blade chamber 52 due to the fuel passing through the blade chamber 52, such that high frequency noise is generated.

As the prior art related to this, Korean Patent Laid-Open Publication No. 2012-0113332 entitled "Impeller for Fuel Pump of Vehicle" has been disclosed.

SUMMARY

An embodiment of the present invention is directed to providing an impeller for a fuel pump of a vehicle capable of decreasing a magnitude of high frequency fluid noise due to high speed rotation of the impeller by forming upper and lower blades of impeller blades positioned between upper and lower casings of the fuel pump and coupled to a shaft of a driving motor to deliver a fuel by rotational force so as to have asymmetrical angles based on the center of a thickness of an impeller body.

In one general aspect, an impeller 1000 for a fuel pump of a vehicle includes: an impeller body 100 having a disk shape and having a shaft fixing hole 120 at the center thereof so as to penetrate therethrough so that a shaft of a driving motor is inserted thereinto and coupled thereto; and a plurality of blades 200 formed at predetermined intervals along an outer circumferential surface of the impeller body 100 and formed in an outward direction of the circumferential surface, wherein each of the blades 200 includes an upper blade **200*a* formed at an upper side of the impeller body 100 in an axial direction and a lower blade 200*b* formed at a lower side of the impeller body 100 in the axial direction, and an angle a of the upper blade 200*a* is larger than an angle b of the lower blade 200*b***.

The angle a of the upper blade **200*a* may be larger than the angle b of the lower blade 200*b*** by 3 to 5 degrees.

A sum of the angle a of the upper blade **200*a* and the angle b of the lower blade 200*b*** may be 90 to 100 degrees.

A height h1 of the upper blade **200*a* may be the same as a height h2 of the lower blade 200*b***.

The impeller for a fuel pump of a vehicle may further include a side ring 300 formed on outer circumferential surfaces of the plurality of blades 200 so as to form blade chambers 210 allowing discharge and introduction of a fuel to be made at upper and lower sides of the blade 200, respectively.

DETAILED DESCRIPTION OF EMBODIMENTS

Hereinafter, an impeller for a fuel pump of a vehicle according to the present invention as described above will be described in detail with reference to the accompanying drawings.

Figure 1:
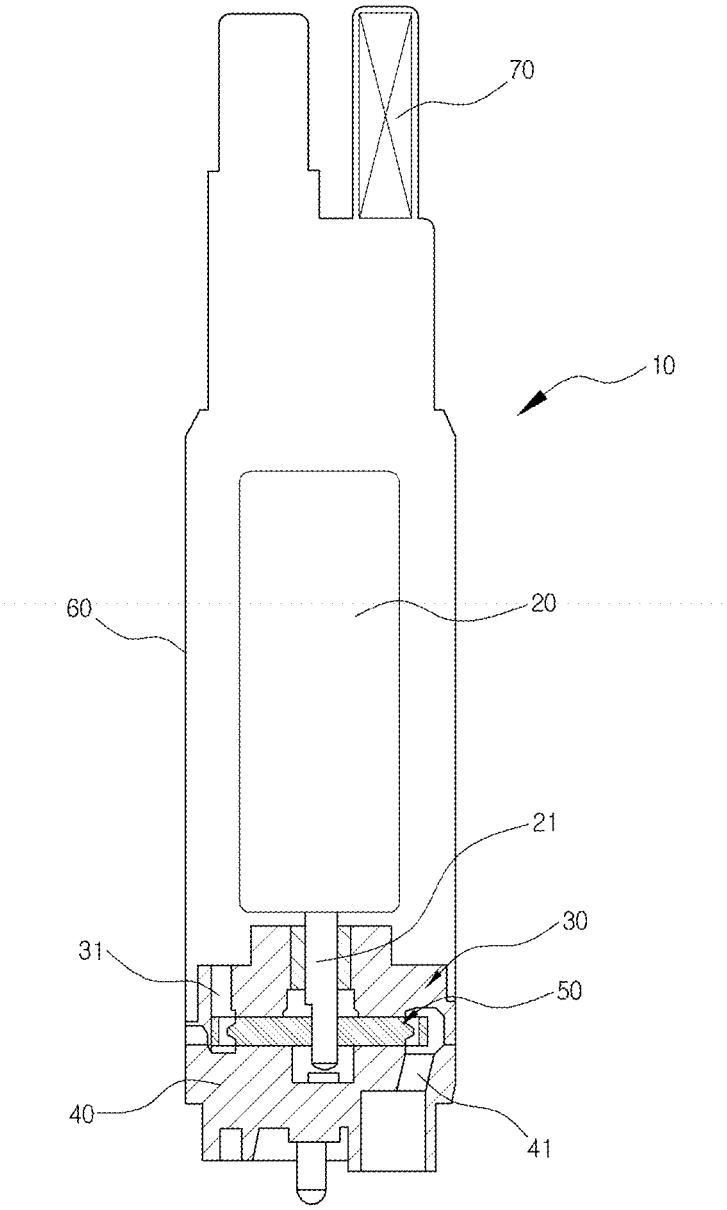
FIG. 1 Prior Art
FIG. 1 is a cross-sectional view showing a schematic configuration of a fuel pump of a vehicle according to the prior art.
Figure 2:
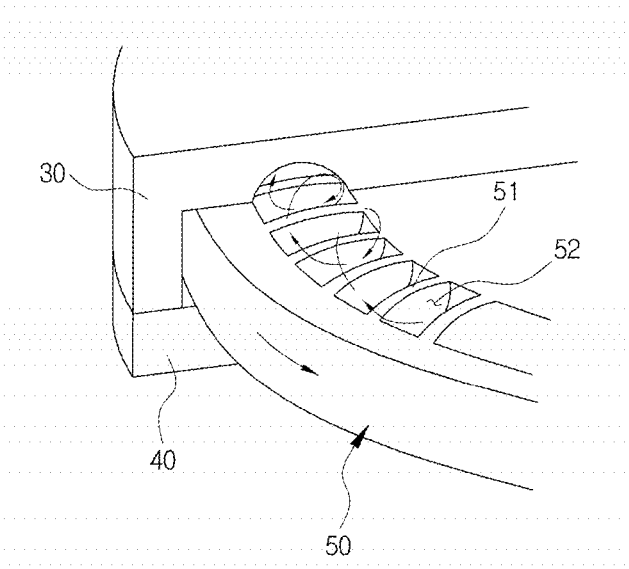
FIG. 2 Prior Art
FIG. 2 is a perspective view showing a structure of an impeller according to the prior art.
Figure 3:
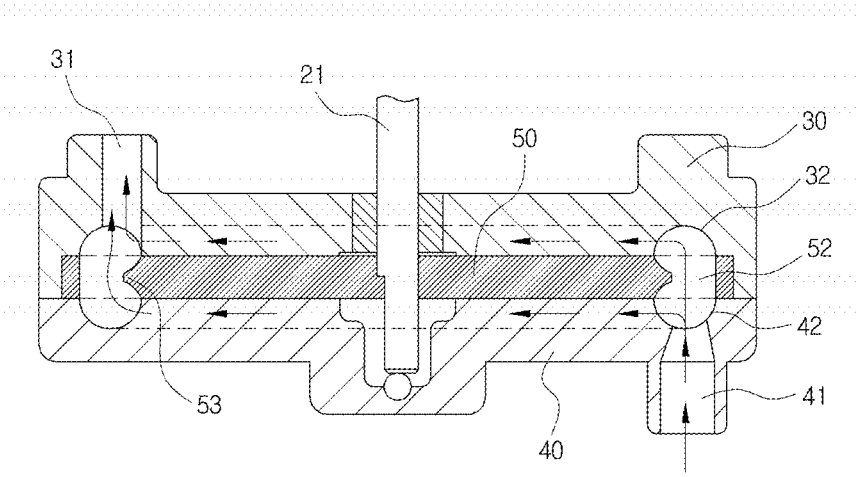
FIG. 3 Prior Art
FIG. 3 is a partial cross-sectional view showing an impeller and upper and lower casings according to the prior art.
Figure 4:
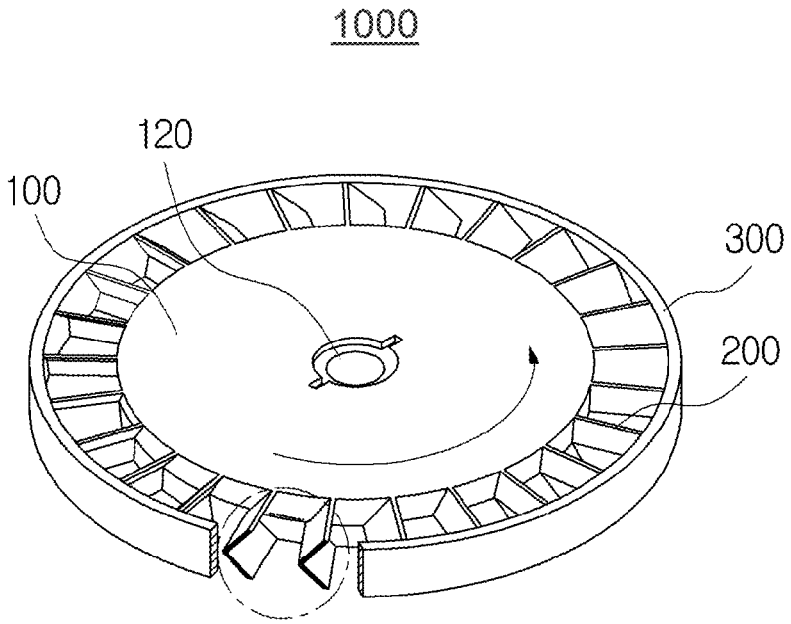
FIG. 4 and FIGS. 5A and 5B are, respectively, a perspective view and a partially enlarged view showing an impeller for a fuel pump of a vehicle according to the present invention.
Figure 5A:
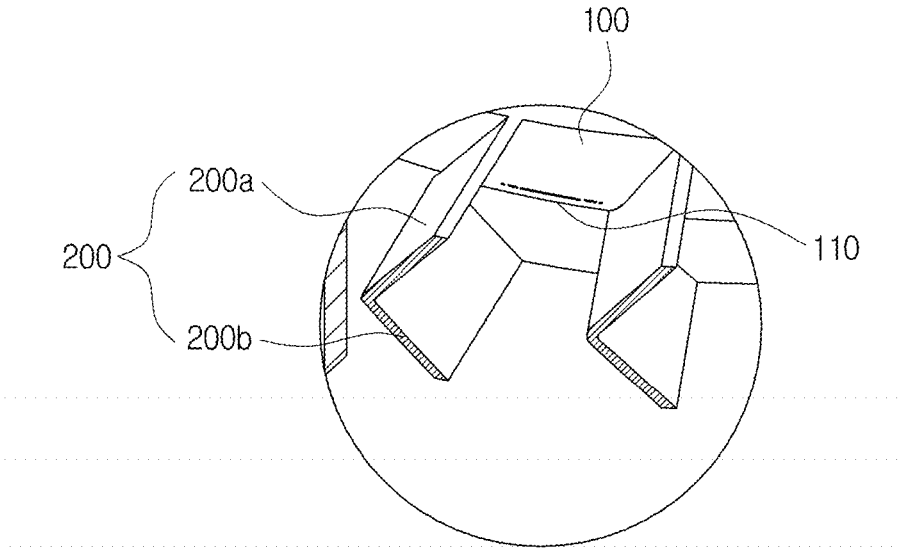
Figure 5B:
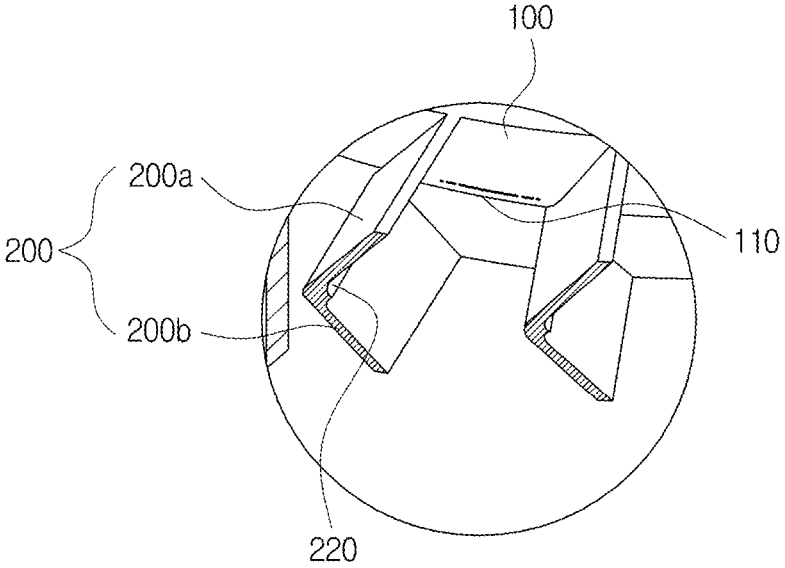
Figure 6A:
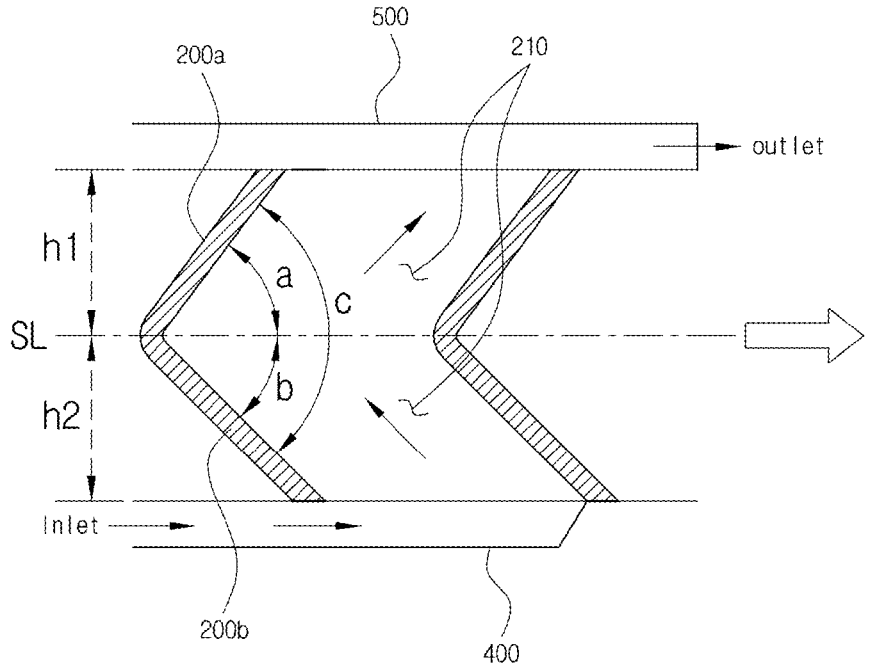
FIGS. 6A and 6B are front views showing a cross section of an impeller blade according to the present invention.
Figure 6B:
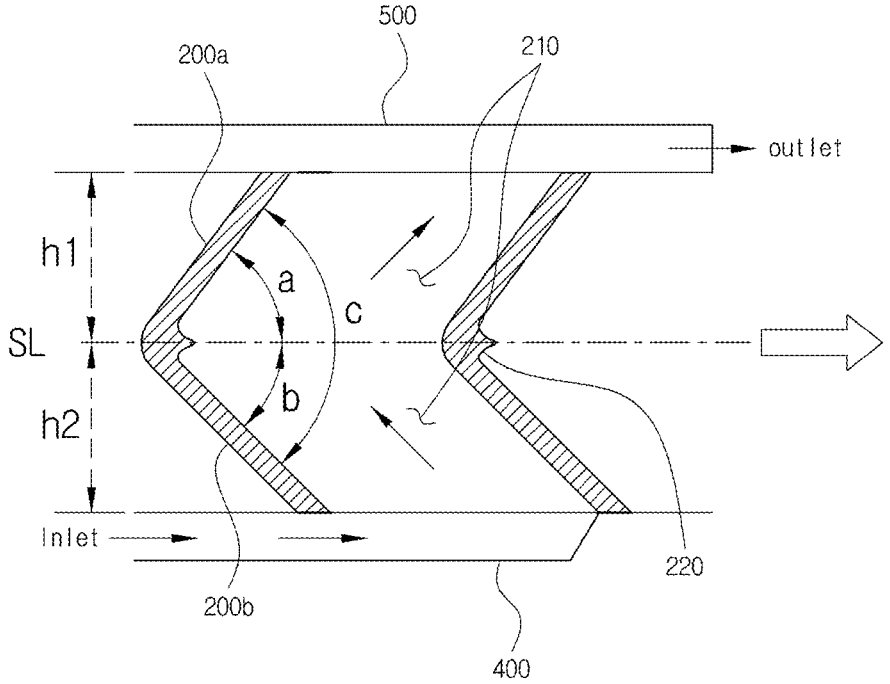

FIG. 4 and FIGS. 5A and 5B are, respectively, a perspective view and a partially enlarged view showing an impeller for a fuel pump of a vehicle according to the present invention, and FIGS. 6A and 6B are front views showing a cross section of an impeller blade according to the present invention.

FIGS. 4 to 6B, an impeller 1000 for a fuel pump of a vehicle according to the present invention is configured to include an impeller body 100 having a disk shape and having a shaft fixing hole 120 at the center thereof so as to penetrate therethrough so that a shaft of a driving motor is inserted thereinto and coupled thereto; and a plurality of blades 200 formed at predetermined intervals along an outer circumferential surface of the impeller body 100 and formed in an outward direction of the circumferential surface, wherein each of the blades 200 includes an upper blade 200*a* formed at an upper side of the impeller body 100 in an axial direction and a lower blade 200*b* formed at a lower side of the impeller body 100 in the axial direction, and an angle a of the upper blade 200*a* is larger than an angle b of the lower blade 200*b*.

The impeller body 100 is formed in the disk shape and has the shaft fixing hole 120 formed at the center thereof.

In addition, the plurality of blades 200 are formed in the outward direction of the circumferential surface of the impeller body 100 at predetermined intervals along the circumferential surface of the impeller body 100 and have blade chambers 210 formed therebetween. That is, the blade chamber 210 is a space formed between two adjacent blades 200.

Here, the blade chamber 210 has a fuel introduced thereinto when the impeller is rotated to generate rotational flows between upper and lower flow passage grooves 500 and 400 each formed in upper and lower casings formed at upper and lower sides of the impeller so as to correspond to positions of the blade chamber 210, such that pressure of the fuel is raised.

Here, the respective blades 200 are formed in the axial direction of the impeller body 100 and has a shape of "<". Here, each of the blades 200 includes the upper blade 200*a* formed at the upper side of the impeller body 100 in the axial direction and the lower blade 200*b* formed at the lower side of the impeller body 100 in the axial direction, and the angle a of the upper blade 200*a* is larger than the angle b of the lower blade 200*b*.

That is, as shown in FIGS. 6A and 6B, an inclined angle a of the upper blade 200*a* formed at an upper side based on a reference line SL is different from an inclined angle b of the lower blade 200*b* formed at a lower side based on the reference line SL, such that the upper blade 200*a* has a form in which it relatively slightly stands and the lower blade 200*b* has a form in which it relatively slightly lies.

Therefore, the fuel introduced into a fuel inlet of the lower casing flows along the lower flow passage groove 400 of the lower casing and then flows to the upper flow passage groove 500 of the upper casing through the blade chamber 210 at an end of the lower flow passage groove 400. Here, impact of a fluid due to the fuel passing through the blade chamber 210 is decreased by the inclined angles of the upper and lower blades 200*a* and 200*b*, such that high frequency noise is decreased.

In addition, flow energy loss of the fluid is decreased due to the decrease in the impact of the fluid, such that pumping efficiency is improved.

Figure 7:
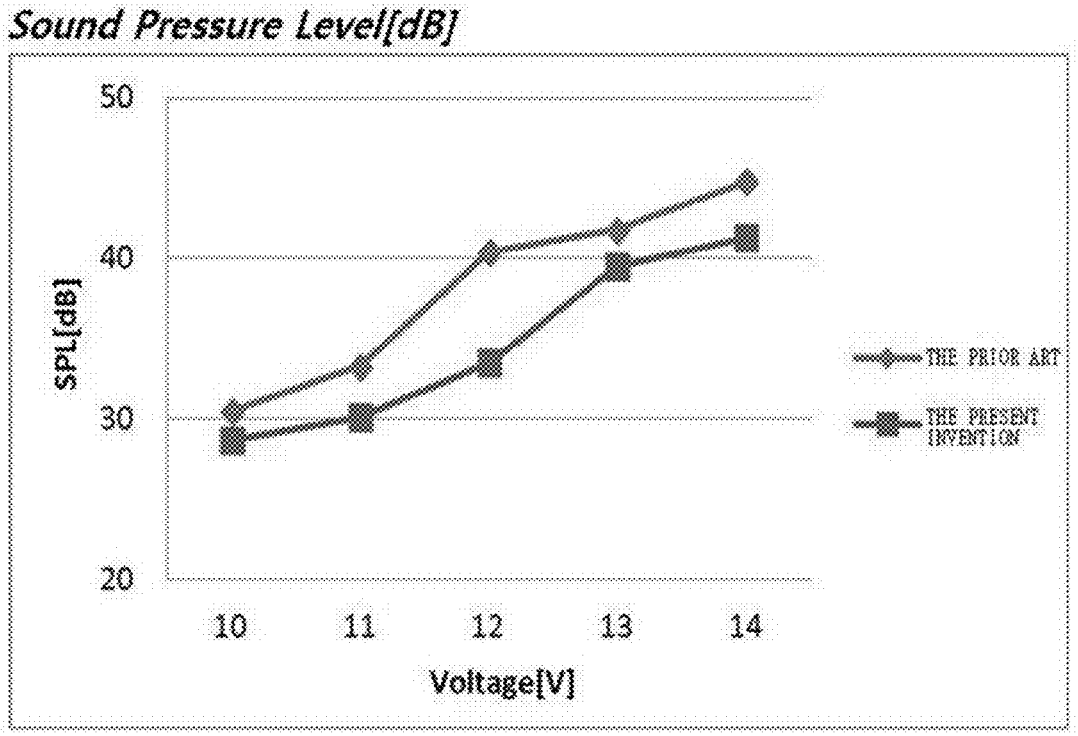
FIGS. 7 and 8 are experimental graphs and data showing a comparison result between noise and pump efficiency of an example of an impeller in which an angle of an upper blade is the same as that of a lower blade according to the prior art and noise and pump efficiency of an example of an impeller in which an angle of an upper blade is larger than that of a lower blade according to the present invention.
Figure 8:
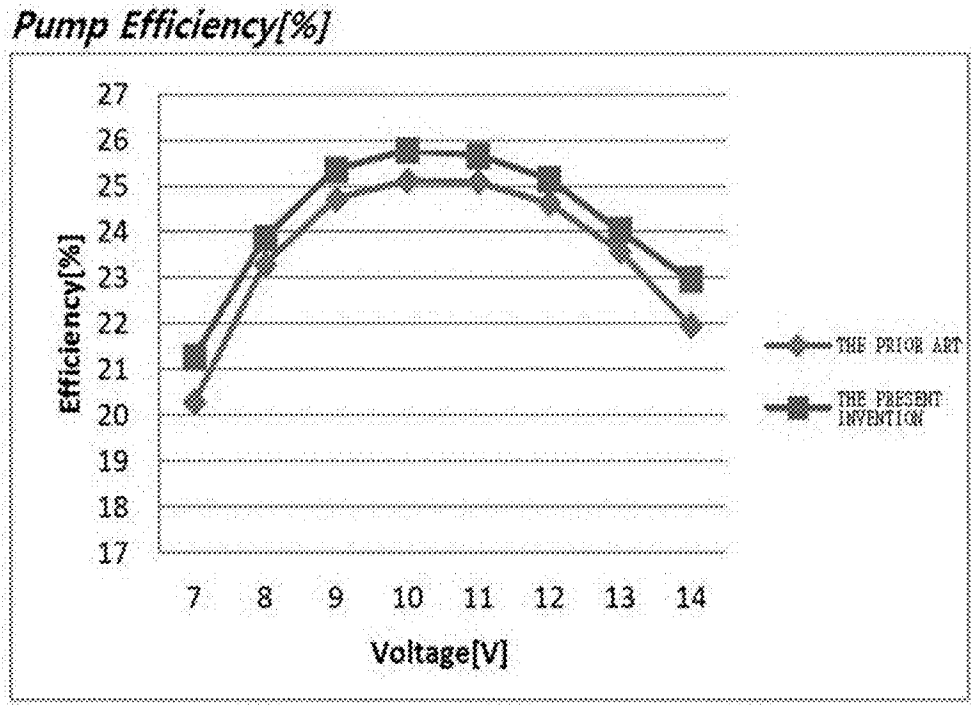

In addition, FIGS. 7 and 8 are experimental graphs and data showing a comparison result between an example of an impeller in which an angle of an upper blade is the same as that of a lower blade according to the prior art and an example of an impeller in which an angle of an upper blade is larger than that of a lower blade according to the present invention. As shown in FIGS. 7 and 8, it may be appreciated that in the impeller according to the present invention, high frequency noise is decreased as compared with an impeller according to the prior art, and pump efficiency is increased as compared with an impeller according to the prior art.

Here, it is preferable that the angle a of the upper blade 200*a* is larger than the angle b of the lower blade 200*b* by 3 to 5 degrees.

That is, when a difference between the inclined angles is excessively small, an impact decrease effect of the fluid may be decreased, and when the difference between the inclined angles is excessively large, a flow resistance of the fluid is increased, such that pumping efficiency may be decreased. Therefore, the upper and lower blades need to be formed in a range of a predetermined angle difference.

In addition, it is preferable that the sum of the angle a of the upper blade 200*a* and the angle b of the lower blade 200*b* is 90 to 100 degrees.

That is, when the sum c of the angles formed by the upper and lower blades 200*a* and 200*b* based on the reference line SL is excessive small or large, pumping performance and efficiency may be deteriorated. Therefore, the upper and lower blades also need to be formed at an appropriate angle.

In addition, a height h1 of the upper blade 200*a* may be the same as a height h2 of the lower blade 200*b*.

Since a circumference center guider 110 may be formed in a protrusion form along the center of the circumferential surface in the impeller body 100, the upper blade 200*a* formed at an upper side based on the circumference center guider 110 formed at the center of a thickness of the impeller body 100 and the lower blade 200*b* formed at a lower side based on the circumference center guider 110 may have the same height as each other.

In addition, each of the plurality of blades 200 may include a blade center guider 220 formed in a protrusion form at the center thereof in a radial direction on a surface thereof in a direction in which the impeller is rotated, wherein the blade center guider 220 may be connected to the circumference center guider 110. The fuel introduced into the blade chamber 210 more efficiently generates rotational flows at each of upper and lower portions of the blade chamber 210 by the circumference center guider 110 and the blade center guider 220 as described above, thereby making it possible to improve the pumping performance. At the same time, the impact of the fluid passing through the blade chamber 210 is decreased, thereby making it possible to decrease the high frequency noise.

Here, the impeller as described above is an impeller applied to an open channel type vehicle fuel pump in which several blades 200 are formed at the impeller body 100, such that all of an upper side, a lower side, and an outer side of the blade chamber 210 are opened. That is, in the open channel type vehicle fuel pump, the fuel introduced into the blade chamber 210 is pushed in the outward direction of the circumferential surface of the impeller body 100 by the rotation of the impeller, such that the rotational flow is formed.

Here, the impeller 1000 for a fuel pump of a vehicle according to the present invention may further include a side ring 300 formed on outer circumferential surfaces of the plurality of blades 200 so as to form the blade chambers 210 allowing discharge and introduction of the fuel to be made and allowing the rotational flows to be formed at the upper and lower sides of the blade 200, respectively.

That is, the impeller 1000 for a fuel pump of a vehicle according to the present invention may be applied to a side channel type vehicle fuel pump in which the upper and lower sides of the blade chamber 210 are opened and the outer side thereof is closed by the side ring 300, such that the discharge and the introduction of the fuel are made at only the upper and lower sides of the blade chamber 210.

Therefore, in the side channel type impeller in which an entire introduced fuel passes through the blade chamber 210 and is then discharged, when the upper and lower blades 200*a* and 200*b* are formed at different angles to decrease the impact of the fluid, the high frequency noise may be further decreased.

In addition, the side ring 300 includes a guider formed in a protrusion form at the center thereof along an inner circumferential surface thereof and corresponding to the circumference center guider 110 formed on the outer circumferential surface of the impeller body 100, thereby making it possible to allow the rotational flow of the fuel to be more efficiently generated in the blade chamber 210.

In the impeller for a fuel pump of a vehicle according to the present invention, a magnitude of high frequency fluid noise due to high speed rotation of the impeller may be decreased.

In addition, the flow energy loss of the fluid is decreased due to the decrease in the impact of the fluid, such that pumping efficiency is improved.

The present invention is not limited to the above-mentioned exemplary embodiments but may be variously applied, and may be variously modified by those skilled in the art to which the present invention pertains without departing from the gist of the present invention claimed in the claims.

What is claimed is:

1. An impeller for a fuel pump of a vehicle comprising:

an impeller body having a disk shape and having a shaft fixing hole at the center thereof so as to penetrate therethrough so that a shaft of a driving motor is inserted thereinto and coupled thereto; and a plurality of blades formed at predetermined intervals along an outer circumferential surface of the impeller body and formed in an outward direction of the circumferential surface, wherein each of the blades includes an upper blade formed at an upper side of the impeller body in an axial direction and a lower blade formed at a lower side of the impeller body in the axial direction, and an angle of the upper blade is larger than that of the lower blade by 3 to 5 degrees.

2. The impeller for a fuel pump of a vehicle of claim 1, wherein a sum of the angle of the upper blade and the angle of the lower blade is 90 to 100degrees.

3. The impeller for a fuel pump of a vehicle of claim 1, wherein a height of the upper blade is the same as that of the lower blade.

4. The impeller for a fuel pump of a vehicle of claim 1, further comprising a side ring formed on outer circumferential surfaces of the plurality of blades so as to form blade chambers allowing discharge and introduction of a fuel to be made at upper and lower sides of the blade, respectively.

* * * * *